United States Patent [19]

Simpson

[11] Patent Number: 4,923,230

[45] Date of Patent: May 8, 1990

[54] SELF-CONTAINED SECURITY LOCK FOR DOUBLE-HUNG WINDOW

[75] Inventor: Harold Simpson, Hazel Crest, Ill.

[73] Assignee: Ashland Products Company, Chicago, Ill.

[21] Appl. No.: 395,742

[22] Filed: Aug. 18, 1989

[51] Int. Cl.[5] ..... E05C 17/50

[52] U.S. Cl. ..... 292/67; 292/DIG. 47; 292/338

[58] Field of Search ..... 292/63, 67, 338, 339, 292/DIG. 15, DIG. 47, 219, 199, DIG. 38, 202, 226

[56] References Cited

U.S. PATENT DOCUMENTS

| | | | |
|---|---|---|---|
| 417,868 | 12/1889 | Jones | 292/67 |
| 614,741 | 11/1898 | Moore | 292/338 X |
| 1,249,176 | 12/1917 | Newman | 292/67 |
| 1,862,056 | 6/1932 | Kelly | 292/202 |
| 1,946,833 | 2/1934 | Brown | 292/219 X |
| 2,615,742 | 10/1952 | Lloyd | 292/199 X |
| 2,681,819 | 6/1954 | Burke | 292/226 |
| 2,920,914 | 1/1960 | Jenkins | 292/67 |
| 4,322,458 | 4/1982 | Eigemeier | 292/DIG. 38 X |
| 4,655,489 | 4/1987 | Bishing | 292/DIG. 38 X |
| 4,824,154 | 4/1989 | Simpson | 292/67 X |

*Primary Examiner*—Richard E. Moore
*Attorney, Agent, or Firm*—Myron C. Cass

[57] ABSTRACT

A security lock for a double-hung sash window assembly which is to be mounted on a stile of one of the sash frames to limit movement of the second sash frame relative to the one sash. The lock includes a casing adapted to be mounted within a recess formed in one of the sash frames, a faceplate of the casing having an opening therein communicating with an interior casing cavity. A tumbler pivots in the cavity and is spring biased to normally project through the opening to engage the second sash. A leaf spring is mounted completely within the casing cavity normally to bias the tumbler into its locking position, but permitting the tumbler to be retracted into the casing. The lock can be supplied as an assembled unit for installation.

7 Claims, 1 Drawing Sheet

FIG. 1
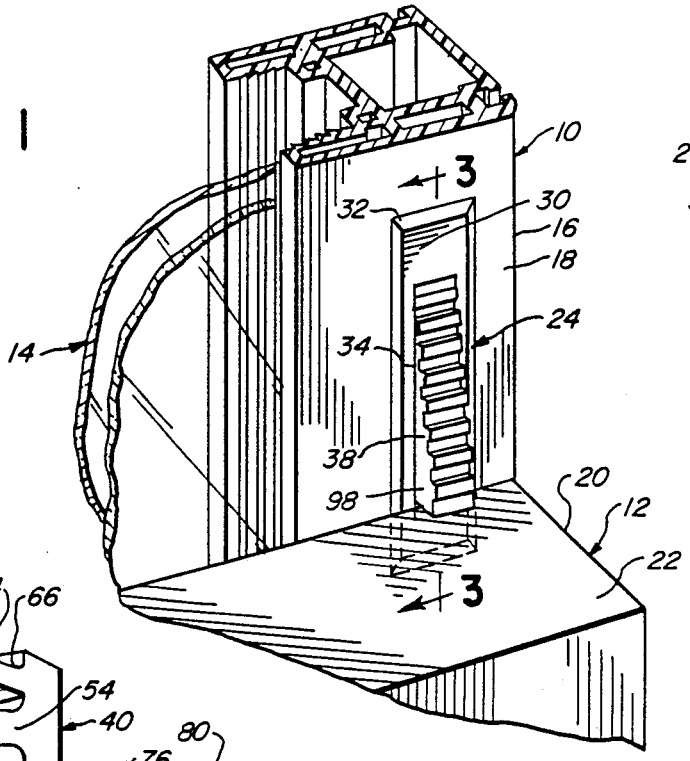
FIG. 2
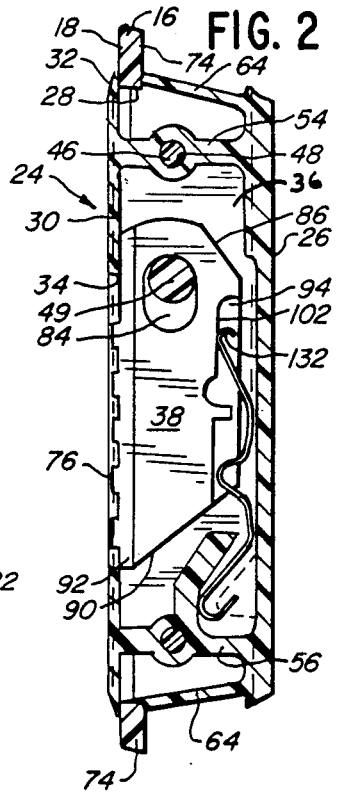
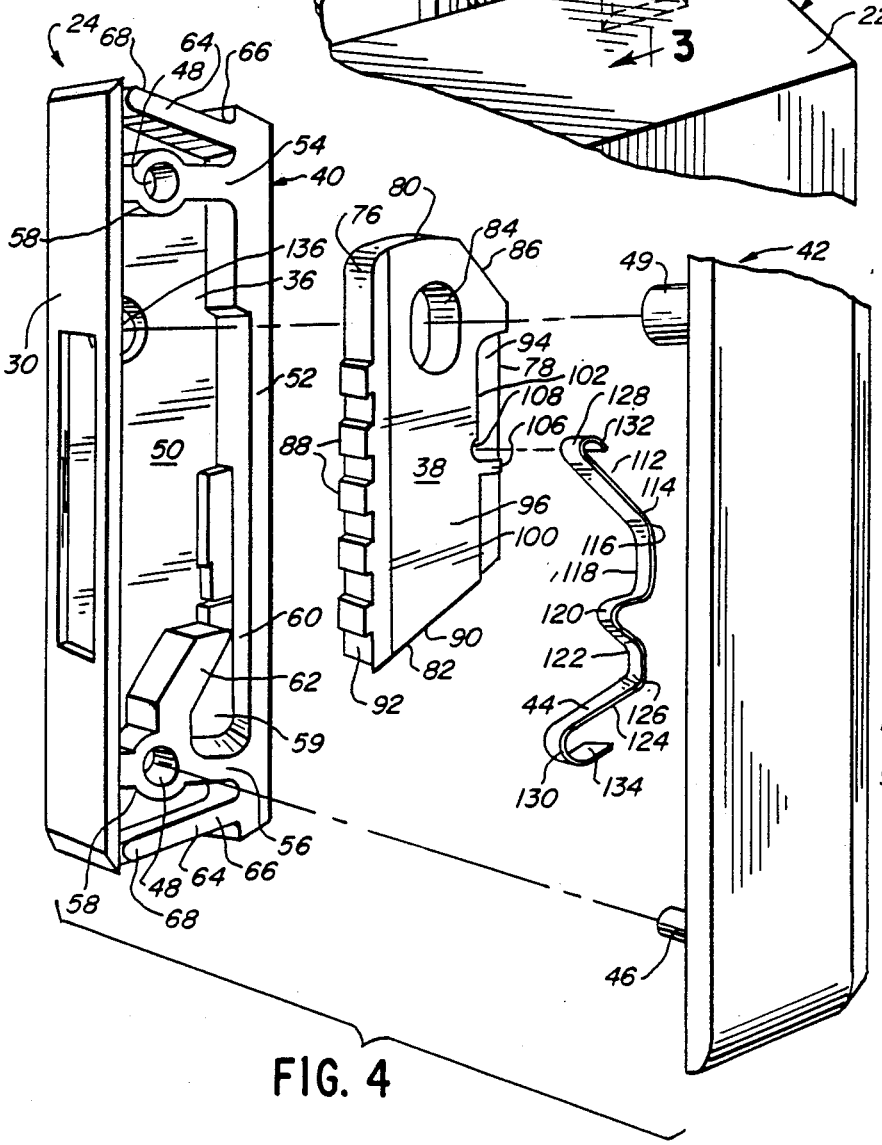
FIG. 4
FIG. 3
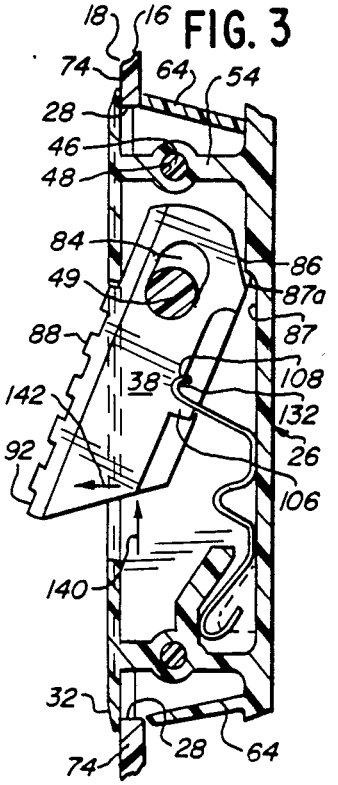

SELF-CONTAINED SECURITY LOCK FOR DOUBLE-HUNG WINDOW

This invention relates generally to a manually operable lock for a window sash of a double-hung window assembly, and more particularly, to a novel lock constructed for easy and rapid assembly for installation as a self-contained unit on a first window sash to prevent or limit movement of the second window sash.

BACKGROUND OF THE INVENTION

A double-hung window assembly typically includes a window frame and a pair of window sashes mounted for vertical reciprocal sliding movement, one relative to the other, in guide rails of the master frame jamb of the window assembly. Although window sashes traditionally have been made exclusively of wood, such window sashes now can be formed of extruded plastic frame members or metal frame members which are joined at mitered corners, for instance, to form a generally rectangular frame in which the glazing is mounted. One type of such a window sash is described, for example, in U.S. Pat. No. 4,578,903 having the same inventor and assignee of the present invention.

Window sashes also are known which include a sash lock or fastener which, when the sash is closed, automatically locks and holds the sash in the closed position. The fastener includes a rectangular casing having an opening at its front end or faceplate in which opening a tumbler or dog is mounted, the casing being mortised into the upper sash and secured therein by screws. The tumbler is mounted within the casing by a guiding device so that the tumbler may be pivotally projected forward or longitudinally to overlie the lower sash and also to be moved laterally when projected forward to engage the casing and lock itself in position. The tumbler is biased in the projected position by a coiled, safety pin type spring mounted within the casing. One type of such a window sash is disclosed, for example, in U.S. Pat. No. 534,185.

Sash security looks or fasteners similar to that disclosed in U.S. Pat. No. 534,185 currently are produced and still employ the safety pin type coil spring described hereinabove. It has been found that in the assembly of such sash locks, the coiled spring is unwieldy and difficult to properly position within the casing thereby contributing to an increase in the labor expenses necessary for their installation.

U.S. Pat. No. 4,824,154, having the same inventor and assignee as the present invention, overcame the disadvantages of the above prior art by providing a security lock for a double-hung sash window assembly which is to be mounted on a stile of a first sash frame to limit movement of the second sash frame relative to the first sash frame. The security lock includes a casing adapted to be mounted within a recess in one of the sash frames, a faceplate of the casing having an opening therein communicating with and overlaying an interior casing cavity. A tumbler is pivotally mounted in the cavity and is spring biased to project through the opening to engage and lock the second sash. A leaf spring is mounted within the casing cavity so that one end of the leaf spring can bias the tumbler into its locking position, while permitting the tumbler to be retracted into the casing. The opposite end of the leaf spring protrudes from the casing into engagement with a side of the stile for retaining the security lock installed in the stile recess. This type of security lock is not desirable in some applications due to the protruding end of the leaf spring, provides no indication to a user that the tumbler is in its locked position, and provides no positive containment of the tumbler in the locked position.

The security lock embodying the invention utilizes a leaf spring which is completely contained within the lock casing and which provides a positive indication and a releasable securement of the tumbler in the locked position. The security lock is designed to enable the lock to be assembled easily and rapidly at reduced labor costs for supply to the window manufacturer for direct installation into the window sash.

SUMMARY OF THE INVENTION

A self-contained security lock is disclosed for use in a double-hung sash window assembly having upper and lower sash window frames formed of assembled header and hollow stile members and installed for vertical reciprocal sliding movement, one relative to the other where the stile of the upper sash frame includes a recess into the interior thereof from a side of the stile. The security lock includes a casing having an internal cavity, a faceplate overlaying the cavity having an opening into the cavity and a pivot lug in the cavity secured to a wall of the casing. The casing is adapted to be installed in the recess with the faceplate surrounding the perimetric edges of the recess. A leaf spring having opposite ends is mounted in the casing and an elongated tumbler is provided having upper and lower ends. The upper end includes a pivot member pivotally mounting the tumbler on the lug in the casing and the lower end is movable between a locking position and retracted position in the opening of the faceplate relative to the header of the lower sash frame. The leaf spring includes one end engageable with the lower end of the tumbler to bias the lower end of the tumbler to protrude beyond the opening into its locking position to engage against the lower sash frame and prevent such relative sliding movement between the sash frames. The pivotally mounted tumbler is retractable manually into the cavity to disengage the lower end of the tumbler from the lower sash frame header and permit such relative sliding movement between the sash frames. The second end of the leaf spring is restrained within the cavity and the lower end of the tumbler, the faceplate and the pivot member are cooperably engageable to releasably maintain the lower end of the tumbler in the retracted position.

BRIEF DESCRIPTION OF THE DRAWINGS

FIG. 1 is a fragmentary perspective view of a portion of a window sash assembly having the self-contained security lock embodying the invention installed in an upper window sash frame of the assembly;

FIG. 2 is a fragmentary longitudinal sectional view taken through the installed lock embodying the invention but showing the lock in its retracted position;

FIG. 3 is a sectional view taken along line 3—3 of FIG. 1 and in the direction indicated generally showing the lock in its extended locked position; and FIG. 4 is an exploded perspective view of the security lock embodying the invention.

BRIEF DESCRIPTION OF THE PREFERRED EMBODIMENT

Referring to the drawings, FIG. 1 generally illustrates a partial representative window of a so-called "double-hung window sash assembly". Such an assembly includes a pair of double-hung upper and lower sashes designated 10 and 12 respectively and fitted with suitable glazing 14, such as shown with the upper sash 10.

The sashes 10 and 12 are mounted within a main jamb frame (not shown) for vertical sliding movement therein. Both the main jamb frame and the sashes 10 and 12 can be formed of a variety of materials, such as metal or strong and rigid plastic or any other desirable material. The sashes 10 and 12 preferably are fabricated from elongate framing members of hollow configuration and are generally rectangular in cross-section and rectilinear in configuration but can vary. The upper sash 10 includes a stile 16 having a front exterior surface 18 and the lower sash 12 includes a header 20 having an upper exterior surface 22.

The lock of the invention is designated generally by the reference character 24 and is shown in FIG. 1 installed in the front surface 18 of the sash stile 16. The precise location of the lock 24 in the stile 16 will be determined by how much vertical movement of the sash 12 is desired before the upper header surface 22 engages the lock 24 as will be described below.

As FIG. 2 illustrates, the lock 24 includes a casing 26 which is designed to be installed in an opening or recess 28 in the front surface 18 of the stile 16. The casing 26 has a front wall or faceplate 30 which overlaps the peripheral edge of the recess 28 to support the casing 26 therein and to provide an aesthetically pleasing appearance.

The faceplate 30 is formed as a solid one piece member and is configured to project only slightly forward of the front surface 18 of the stile 16 so as to not interfere with the relative sliding movement of the sashes 10 and 12. To this end, the faceplate 30 may be provided with a beveled outer peripheral edge 32.

The faceplate 30 includes a centrally located elongate vertical opening 34 which is in communication with an interior cavity 36 of the casing 26. An elongate tumbler 38 is mounted within the cavity 36 to pivot therein and to lockingly engage the upper surface 22 of the lower sash header 20.

Referring to FIG. 4, the lock 24 is illustrated in greater detail. For ease of assembly, the casing 26 is formed of two mating portions 40 and 42 which will be referred to as the housing portion and the side cover portion respectively. The housing portion 40 is the larger of the two portions and defines the cavity 36 into which the tumbler 38 and a spring 44 are operatively located. The side cover portion 42 serves as a cover for the otherwise open side of the housing portion 40 and assists in retaining the tumbler 38 and spring 44 therein. The cover portion 42 is attached to the top and bottom of the housing portion 40 respectively, by a lug 46 which matingly engages a bore 48 in the housing portion 40, FIG. 4 only illustrating the bottom lug 46. The lugs 46 can be snap-fit within the bores 48, secured with an adhesive or any other desired way. The cover portion 42 also includes a pivot lug 49 whose free end engages an aperture in the tumbler 38 as will be described in detail below.

The housing portion 40 includes a side wall 50 which opposes the side cover portion 42, a back wall 52 which opposes the faceplate 30, a top wall 54 and a bottom wall 56. The faceplate 30, the back wall 52, the top wall 54 and the bottom wall 56 are all integral with the side wall 50.

In the preferred embodiment, the top wall 54 and the bottom wall 56 are provided with enlarged portions 58 integral therewith which extend into the cavity 36 and provide support to the casing 26 and define the bores 48. In order to seat one end of the spring 44 within the casing 26, the back wall 52 is provided with an internal cavity 59 having a notch or passageway 60 between a wall portion 62 and the inside face of the back wall 52. The mounting of the spring 44 within the cavity 59 and the passageway 60 will be described in detail later.

As FIGS. 2 and 3 illustrate, at both ends of the casing 26 the top and bottom walls 54 and 56 are provided with an elongate spring clip 64 positioned proximate thereto and integral at one end 66 with the back wall 52 and include a free end 68. The clips 64 are arranged so that they engage edges 74 of the stile surface 18 defining the opening 28 and exert a slight biasing force thereagainst to secure the casing 26 within the opening 28. In effect, the edges 74 are sandwiched between the clips 64 and the peripheral beveled edge 32 of the casing 26.

The tumbler 38 includes a front edge 76, a rear edge 78, an upper end 80 and a lower end 82. To engage the pivot lug 49 and provide rotation to the tumbler 38, an ovate transverse aperture or pivot bore 84 is located near the upper end 80 of the tumbler 38 approximately equidistant from the front edge 76 and the rear edge 78. The upper end 80 of the tumbler 38 includes a tapered formation 86 which preferably abuts the back wall 52 of the casing 26 when the tumbler 38 is in an extended or locked condition as shown in FIGS. 1 and 3. Alternatively, the upper end 80 can be formed to similarly abut the top wall 54, with or without the engagement of the tapered formation 86 against the back wall 52. To assist in maintaining the tapered formation 86 in a stable position against the back wall 52, the back wall 52 can include a recess 87 which defines an edge **87*a* for engagement with the tapered formation 86**.

To assist in moving the tumbler 38, the front edge 76 of the tumbler 38 can include a plurality of outstanding ribs 88. The ribs 88 can assume many different configurations.

The lower end 82 of the tumbler 38 is provided with a tapered lower edge 90 which assists the pivoting motion of the tumbler 38 within the opening 28. In addition, the lower edge 90 intercepts the front edge 76 to form an engagement portion 92 which is adapted to engage the faceplate 30 near the lower end of the opening 28 when the tumbler 30 is retracted in the casing 26. The interaction between the engagement portion 92 and the faceplate 30 locks the tumbler 38 in a retracted condition as seen in FIG. 2.

The rear edge 78 includes a recess 94 therein which extends from just below the pivot bore 84 to the lower end 82. The recess 94 is open on one side 96 of the tumbler 38 but does not extend the entire width of the tumbler 38 to the opposite side 98 as best seen in FIG. 1. A wall portion 100 integral with the tumbler 38 defines the recess 94.

The recess 94 includes a wiping surface 102 having a stop member 106 and at least one detent member 108 for the spring 44. The spring 44 preferably is a leaf spring formed of a flat elongate member and is substantially 'W'-shaped, having an upper arm 112 integral at one end 114 with a first end 116 of a center portion 118, the center portion 118 having a wedge-shaped crease 120 centrally located thereon and a second end 122 integral with a lower arm 124 at the opposite end 126 of the spring 44. The upper and lower arms 112 and 124 include free ends 128 and 130. Each of the free ends are doubled over to form upper and lower hook formations 132 and 134 respectively.

Preferably, the hook formation 132 of the spring 44 has a smaller radius than the other hook formation 134 and is constructed to seat within the detent member 108. Accordingly, upon movement of the tumbler 38 the hook formation 132 can move into the detent member 108 and against the stop member 106 thereby providing an audible "click" as well as imparting a "feel" to a user that the tumbler is positioned as desired. The operation of the tumbler 38 will be described in detail below.

To assemble the lock 24, the tumbler 38 is positioned in the cavity 36 of the housing portion 40 of the casing 26 so that the pivot bore 84 preferably is aligned with an aperture 136 in the side wall 50 of the housing portion 40. The spring 44 then is located near the bottom wall of the casing 26 between the rear edge 78 of the tumbler 38 and the back wall 52 of the casing 26. The hook formation 134 is positioned within the internal cavity 59 and the second end 122 extends through the passageway 60. Upon proper positioning of the spring 44, the cover portion 42 is snap-fit to the housing portion 44 by means of the mating lugs 46 and bores 48. The lock 24 then can be installed in the opening 28 of the stile 16 so that the spring clip members 64 snap into engagement with the edges of the opening 28.

In the retracted or unlocked position of the lock 24 as illustrated in FIG. 2, the spring 44 is positioned within the cavity 36 of the casing 26 so that the hook formation 132 slidingly engages the wiping surface 102 of the recess 94. The spring 44 thus exerts an outward force against the tumbler 38 which biases the depending portion 92 of the lower end 82 thereof against the inside lower end of the faceplate 30. The tumbler 38 is thus maintained in an inoperative, retracted position.

When it is in the retracted position shown in FIG. 2, the tumbler 38 is positioned within the cavity 36 so that the ovate pivot bore 84 engages the pivot lug 49 at an upper end of the bore 84. In addition, the upper tapered formation 86 of the tumbler 38 is not in contact with the rear wall 52 or upper wall 54 of the casing 26. The front edge 76 of the tumbler 38 is flush with the opening 34 in the faceplate 30 to facilitate the relative sliding action of the upper and lower sashes 10 and 12.

Referring to FIG. 3, when it is desired to lock the lower sash 12 to prevent upward sliding movement thereof, the tumbler 38 is actuated with the assistance of ribs 88 and is moved in an upward vertical direction indicated by the arrow 140. The upward movement of the tumbler 38 is terminated by the engagement of the pivot lug 49 with the lower end of the ovate pivot bore 108, and further by the contact of the upper tapered formation 86 with the back wall 52 of the casing 26. The tumbler 38 need only be moved vertically upward a sufficient distance to permit the engagement portion 92 thereof to clear the faceplate 30. Once the engagement portion 92 is clear of the faceplate 30, the spring 44 urges the tumbler 38 forward through the opening 34 in the direction indicated by arrow 142. The tumbler 38 will move in the direction of arrow 142 until the hook formation 132 abuts the stop member 106 and seats within the detent member 108. Preferably, the lower edge 90 of the tumbler 38 extends outward from the casing 26 to a distance roughly corresponding to half of the length of the lower edge 90, but can vary. Additionally, the back wall 52, or any other portion of the casing 26, can be formed to assist in limiting the outward extension of the tumbler 38 if desired. The tumbler 38 easily is retracted and locked within the opening 34 by first moving the tumbler 38 inward with sufficient force to force the hook formation 132 out of the detent 110 and then reversing the above procedure.

Minor variations in the structure and in the arrangement and size of the various parts may occur to those skilled in the art without departing from the spirit and scope of the invention as set forth in the claims hereof.

I claim:

1. A self-contained security lock for use in a double-hung sash window assembly having upper and lower sash window frames formed of assembled header and hollow stile members and installed for vertical reciprocal sliding movement one relative to the other, a stile of said upper sash frame having a recess into the interior thereof from a side of the stile, said security lock comprising:

A. a casing having an internal cavity, a faceplate overlaying said cavity having an opening into said cavity and a pivot lug in said cavity secured to a wall of said casing, said casing adapted to be installed in said recess with said faceplate surrounding the perimetric edges of said recess;

B. a leaf spring having opposite ends and mounted in said cavity;

C. an elongated tumbler having upper and lower ends with said upper end pivotally mounted on said lug in said casing and said lower end being movable between a locking position and a retracted position in said opening of said faceplate relative to said header of said lower sash frame;

D. said leaf spring having one end engageable with said lower end of said tumbler normally to bias said lower end of said tumbler to protrude beyond said opening into said locking position to engage against said lower sash frame and prevent such relative sliding movement between said sash frames;

E. said pivitally mounted tumbler being retractable manually into said cavity to disengage said lower end of said tumbler from said lower sash frame header and permit such relative sliding movement between said sash frames;

F. said second end of said leaf spring being restrained within said cavity; and

G. said tumbler including a countoured recessed surface extending along the length of said tumbler, said recessed surface including a stop member, said one end of said leaf spring being slidable along said recessed surface during pivotal movement of said tumbler between said locking position against said stop member and said retracting positions away from said stop member.

2. The security lock as defined in claim 1 in which said tumbler has an enlarged bore through which the pivot lug is engaged.

3. The security lock as defined in claim 1 in which said leaf spring is substantially W-shaped and said ends thereof have hook formations opening in the same direction, the hook formation of said one end having a bight thereof slidable along said surface.

4. The security lock as defined in claim 3 in which said recessed surface includes a detent member for engagement with said bight to assist in maintaining said tumbler in said locked position.

5. The security lock as defined in claim 1 in which said casing includes means for engaging opposite edges of said stile recess for retaining said security lock installed in said stile recess.

6. The security lock as defined in claim 1 wherein said casing includes a removable side wall for entry into said casing, said casing and said side wall having cooperating pin and socket securement means for releasably securing said side wall to said casing.

7. The security lock as defined in claim 6 wherein said pivot lug is integral with said removable side wall.

* * * * *